United States Patent [19]

Engelhardt

[11] 4,415,154

[45] Nov. 15, 1983

[54] BALL AND TARGET

[76] Inventor: Gerald J. Engelhardt, 312 Blackberry La., Yorkville, Ill. 60560

[21] Appl. No.: 238,147

[22] Filed: Feb. 25, 1981

[51] Int. Cl.[3] ..... A63B 69/00; A63B 39/06

[52] U.S. Cl. ..... 273/26 A; 273/346; 273/60 R; 273/58 BA; 273/65 EG

[58] Field of Search ..... 273/346, 60 R, 60 A, 273/60 B, 58 B, DIG. 20, DIG. 30, 58 BA, 61 A, 26 R, 26 A, 26 D, 65 EG

[56] References Cited

U.S. PATENT DOCUMENTS

| | | | |
|---|---|---|---|
| 1,580,230 | 4/1926 | Brereton | 273/58 BA |
| 1,672,174 | 6/1928 | Ruedy | 273/60 R |
| 2,254,986 | 9/1941 | Ziel | 273/25 |
| 2,753,599 | 7/1956 | Pietraszek et al. | 273/60 B X |
| 3,401,941 | 9/1968 | Hesidence | 273/346 X |
| 3,450,405 | 6/1969 | Mates | 273/DIG. 30 |
| 3,458,194 | 7/1969 | Coles | 273/DIG. 30 |
| 3,711,092 | 1/1973 | Hogue | 273/67 R |
| 3,721,447 | 3/1973 | Louderback | 273/DIG. 30 X |
| 3,917,271 | 11/1975 | Lemelson | 273/106 R |
| 3,976,295 | 8/1976 | Heald | 273/60 R |
| 4,017,076 | 4/1977 | Bai | 273/102 R |
| 4,029,316 | 6/1977 | Clarke | 273/58 K |
| 4,113,251 | 9/1978 | Imes | 273/95 R |
| 4,244,576 | 1/1981 | Mosier et al. | 273/DIG. 30 X |
| 4,261,565 | 4/1981 | Massino et al. | 273/60 A X |

FOREIGN PATENT DOCUMENTS

| | | | |
|---|---|---|---|
| 493100 | 5/1953 | Canada | 273/60 R |
| 1489655 | 10/1977 | United Kingdom | 273/DIG. 30 |
| 1489751 | 10/1977 | United Kingdom | 273/DIG. 30 |

*Primary Examiner*—George J. Marlo
*Attorney, Agent, or Firm*—Evan D. Roberts

[57] ABSTRACT

A low density hollow spherical ball body having radially extending openings spaced apart uniformly and extending therethrough is encased in a covering of an inter-resilient reinforcing layer and an outer flexible enclosing layer. A soft impact deadening target is provided for use with the ball. The target is adjustably and detachably mounted in a frame by elongated pile tabs attached to the peripheral front of the target and adapted to be wrapped around the frame and attached to the back of the target. The ball is burr coated and the target is provided with burr adherent material.

8 Claims, 10 Drawing Figures

BALL AND TARGET

SUMMARY OF THE INVENTION

This invention relates to a practice ball and ball target for use therewith wherein the ball has a low density sphere body and can be thrown to appropriately simulate the path of a normal baseball and which can be struck by a bat in the fashion of a baseball. Low density balls tend to be too light and weak to provide a normal simulated trajectory reaction to striking and throwing as would a normal baseball, golf ball or other simulated sport ball. However, the ball of this invention with its low density sphere forming the body of the ball will simulate the trajectory and reaction of a normal high density sport ball. To accomplish this, among other things, a covering is provided on said ball which provides resilient strength, wind resistance or reaction and a simulated normal grip for the thrower. This allows the ball to be thrown, and otherwise manipulated, in a fashion to simulate the path and projectory of a normal ball, but on a reduced scale.

Further, the ball is provided with a resilient inner covering adhered to the ball body to strengthen and improve the resilient characteristics of the ball while providing an appropriate surface for an outer covering. The outer covering provides a further strengthening layer and a simulation of a normal baseball in combination with the structure of this ball to allow the thrower of the ball to feel and throw the ball in a baseball throwing fashion, whereby the ball will react in a simulated baseball manner, on a reduced scale of distance. The ball further is provided with burr material on the outer surface and the target is provided with a pile surface for receiving contact of the ball covering burr material to allow the ball to releasably adhere to the target when the target is struck by the ball, and to provide frictional ridges on the surface of the ball to react with the air, when the ball is thrown, whereby the ball simulates the action of a normal baseball.

The target has a resiliency to dampen the rebound action of the ball, as the ball strikes the target, to allow the ball to be retained by the surface of the target.

Other advantages and novel aspects of the invention will become apparent upon review of the following detailed description in conjunction with the accompanying drawings wherein.

Figure 1:
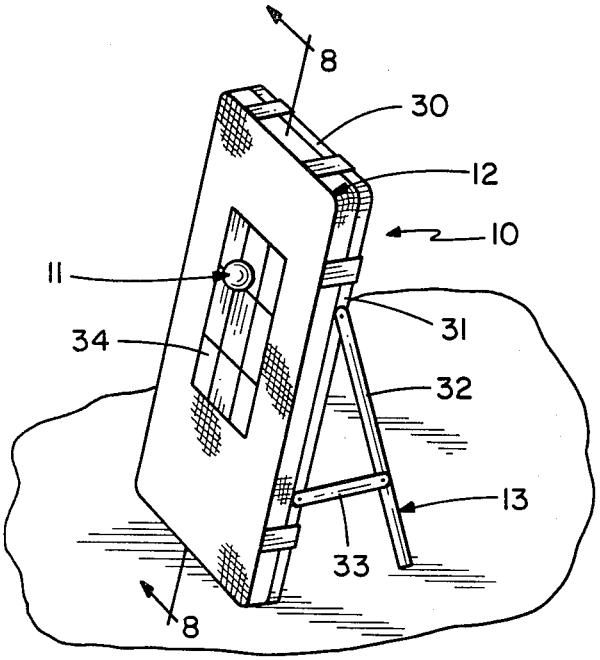
FIG. 1 is a general perspective representation of the resilient low density simulated baseball of this invention removably attached to the target of this invention illustrating the interrelationship of the ball and target thereof.

The ball and ball target of this invention, generally represented by the numeral 10 is broadly shown in FIG. 1 and includes ball 11 for use with target 12 and frame 13 for supporting target 12 for use with ball 11.

Figure 6:
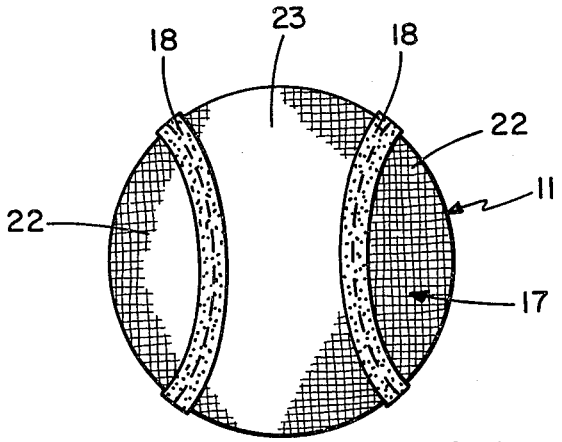
FIG. 6 is a view of the assembled ball of this invention showing burr material applied in a pattern along the seams of the stretchable resilient figure 8-shaped outer covering pieces of the outer surface of the ball.
Figure 7:
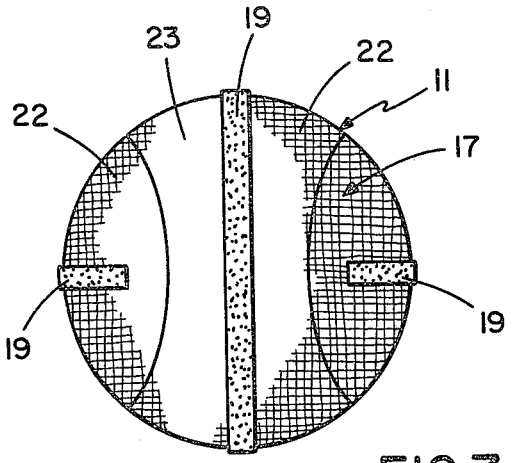
FIG. 7 is a view of the assembled ball of this invention showing additional burr material applied to the stretchable resilient figure 8-shaped outer surface covering pieces of the ball, between the burr material pieces provided on the seams of said ball, as an alternative or additional provision of burr material.

Ball 11 includes a low density spherical ball body 15 (FIG. 2), and inner resilient layer 16 thereover (FIG. 3), an outer covering layer 17 (FIGS. 4–7) and burr material 18 and 19 (FIGS. 6 and 7) secured to outer covering layer 17.

Figure 2:
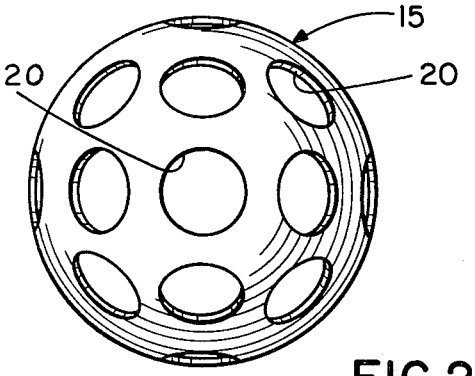
FIG. 2 is a view of the resilient low density spherical ball body of the ball of this invention.
Figure 3:
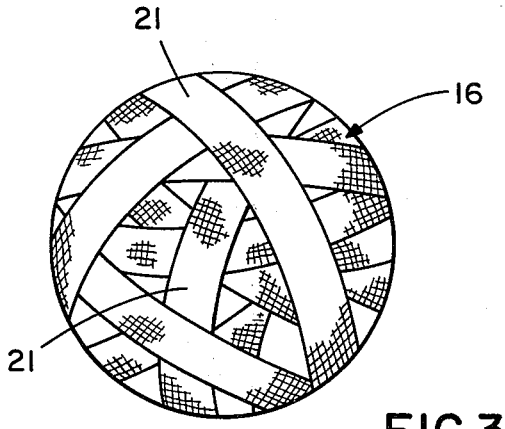
FIG. 3 is a view of the spherical ball body of this invention covered by a resilient layer of adhesive fabric tape.
Figure 4:
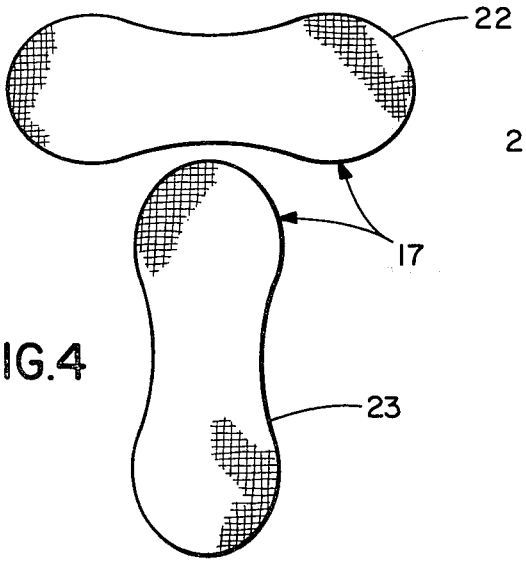
FIG. 4 is a view of two pieces of flexible stretchable figure 8-shaped outer covering pieces for providing a spherical outer cover of the ball of this invention.
Figure 5:
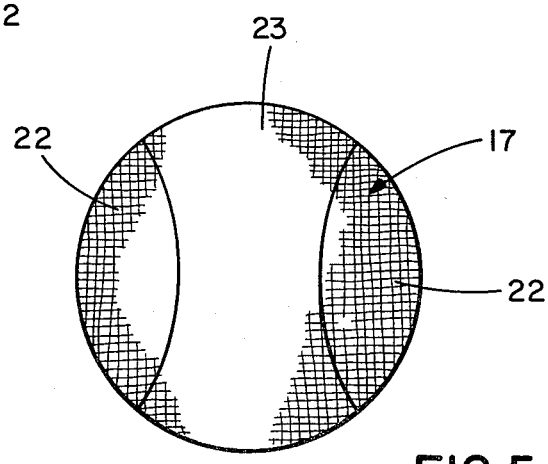
FIG. 5 is a view of the ball of this invention with the two stretchable resilient figure 8-shaped outer covering pieces referred to in FIG. 4 as applied thereto.

Ball body 15 is illustrated as a hollow plastic sphere with radial openings 20 extending therethrough (FIG. 2). Body 15 can be constructed of homogeneous porous plastic so as to be of low density, but with the highest possible strength characteristics attainable with low density. Inner covering 16 is adhesive tape material 21 such as athletic adhesive tape and provides a strengthening of sphere body 15 while providing resilient inner layer 16 to enhance the simulated reaction characteristics of ball 11.

Figure 8:
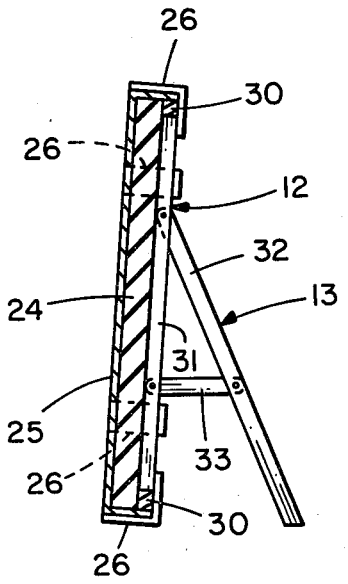
FIG. 8 is a cross-sectional view taken along line 8—8 of FIG. 1 showing the composition and configuration of the target and the supporting stand therefor.

Outer covering 17 (FIGS. 4–7) includes two substantially figure 8-shaped pieces of material 22 and 23 peripherally shaped like that of a normal baseball covering, but which are of stretchable resilient material such as double knit plastic fabric to provide retention of pieces 22 and 23 on inner covering 16 on ball body 15 as ball 11 may be struck by a bat or otherwise similarly contacted or struck. Burr material 18 or 19 can be such as the tape sold under the trademark "VELCRO". This tape is characterized by an adhesive back with a face or pile of hooklike spines which simulate properties of natural burr material. Such burr material 18 can thus be applied to ball covering 17 as illustrated (FIGS. 6 and 7) by the adhesive back thereof or by other similar means.

In addition to, or in the alternative, burr material 19 can be applied between the seams of coverings 22 and 23 (FIG. 7) to provide additional burr material for an alternate position of burr material 19. Thus, the retention effects of burr material 18 or 19 with respect to target 12 and the effects of burr material 18 or 19 on wind resistance and corresponding trajectory of the wall can be controlled by the positioning of burr material 18 or 19 on covering 17 and by the amount of the burr material 18 or 19 applied to covering 17.

Target 12 has a cloth surface 25 and compressible main body 24, formed of foam rubber or the like, sufficient to receive the impact of ball 11 and yet resilient and soft enough to deaden the tendency of ball 11 to ricochet when ball 11 strikes target 12. Surface 25 is a flannel double knit material glued to or otherwise secured to target foam body 24 to provide the pile material necessary to interreact with burr material 18 or 19 of ball 11 to allow ball 11 to stick to target 12 when striking same.

In addition, covering 25 is provided with pile tabs 26 adapted to be folded from front surface 27 of target covering 25 toward back 28 of target 12 and appropriately position burr material 29 on back 28 of target 12. Tabs 26 allow target cover 25 to be applied to horizontal and vertical frame elements 30 and 31 of support frame 13 and thus detachably secure target 12 to support frame 13 (FIGS. 1 and 8). A target area or strike zone 34 can be applied to covering 25 of target 12 to indicate the area being struck by ball 11 because ball 11 will be retained on covering 25 when thrown or hit thereagainst. Frame 13 is further provided with legs 32 attached to vertical frame elements 31 by bar 33 to provide an upright support or frame to hold target 12 in position (FIGS. 1 and 8) to receive ball 11.

Figure 9:
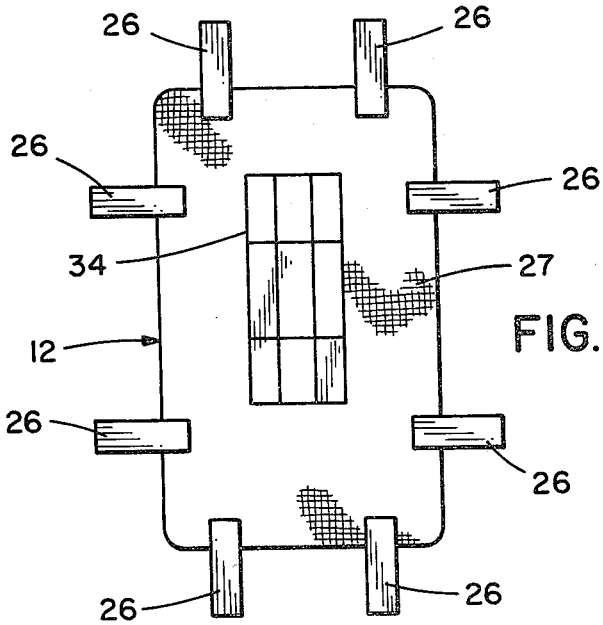
FIG. 9 is a front plan view of the target of this invention showing the structure thereof and specifically showing securing burr tabs for retaining the target to its supporting frame.
Figure 10:
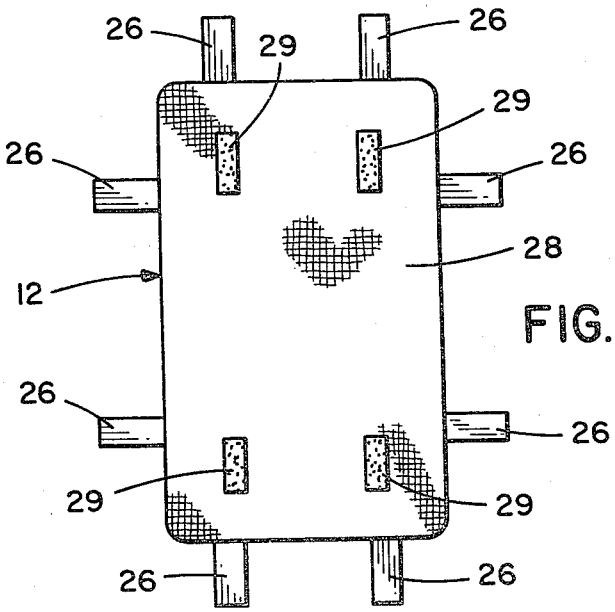
FIG. 10 is a rear plan view of the target of this invention showing the structure thereof and specifically showing the securing burr tabs and corresponding burr retaining areas positioned on the back of the target to cooperate with said tabs for said retention to the supporting frame.

Further, the placement of pile tabs 26 in the horizontal and vertical positions shown in cooperation with respective burr material 29 allows target 12 to be adjustably fastened to any appropriately adapted vertical and horizontal surfaces. In particular, target 12 can be fastened to a wire mesh baseball backstop by threading tabs 26 through said backstop and can be readily adjusted thereon by adjusting the contact of tabs 26 with corresponding pile surface 29. In this regard, although pile surface 29 is shown (FIGS. 9 and 10) as relatively small patches, it is contemplated by the inventor that this burr material could be applied in an elongated and wide fashion to allow more varied adjustment of tabs 26 relative to burr material 29 to facilitate adjustment of target 12 on whatever upright frame or mesh is sought to be applied to.

In operation, ball 11 is gripped in a fashion similar to that of the grip for a regular baseball by placing the fingers of the hand in and about the seams and burr materials 18 and 19 of cover 17. Ball 11 is thrown with a spinning action to a desired degree to provide, or to otherwise simulate, the normal curve of a ball. However, because of the greatly reduced density of ball 11, the simulation is doen on a scaled down distance version of the trajectory of a normal baseball or whatever ball size and shape ball 11 may be designed to simulate.

Ball 11 can be struck by a bat and will simulate the trajectory of a baseball, on the reduced distance scale. Thus, ball 11 provides a ball for practicing, by simulation of the action, a ball without requiring the vast open spaces for the regular distance action of a baseball, or other ball which ball 11 of this invention is constructed to simulate.

It is to be understood that the invention is not to be limited to the specific constructions and arrangements shown and described, as it will be understood to those skilled in the art that certain changes may be made without departing from the principles of the invention.

What is claimed is:

1. A practice ball and a ball target for use with said ball comprising a hollow spherical plastic ball body having openings therethrough, a covering on the surface of said sphere for enclosing and strengthening said sphere as a ball, and a target for receiving said ball, said covering having a resilient inner layer adhered to said sphere substantially uniformly to and over the outer surface of said sphere for resiliently reinforcing said sphere, and an outer layer for providing a ball surface to contain said resilient reinforcing inner layer and said sphere.

2. A practice ball and a ball target for use with said ball as defined in claim 1, wherein said sphere has radially extending openings spaced apart uniformly over said sphere and therethrough.

3. A practice ball and a ball target for use with said ball as defined in claim 2 wherein said resilient reinforcing layer comprises an adhesive fabric tape applied adherently over said sphere.

4. A practice ball and a ball target for use with said ball as defined in claim 1 wherein said outer layer comprises two pieces of stretchable resilient material of a baseball cover figure 8 type configuration adapted for being interfittedly secured together along respective peripheral surfaces thereof to form a complete spherical ball covering, and said covering is provided with burr material along the seams thereof for contact with a pile surface to detachably adhere thereto and to provide exaggerated prominence in the feel of said seams as the ball may be gripped for throwing and exaggerated friction with the air as said ball may be caused to pass therethrough.

5. A practice ball and a ball target for use with said ball as defined in claim 4 wherein said target has a pile surface for receiving contact of said ball covering burr material to tend to detachably adheredly retain said ball thereto upon contact therewith.

6. A practice ball and a ball target for use with said ball as defined in claim 5 wherein said target has a compressible, semi-resilient impact deadening body supported by a frame and with a target surface adjustably attached to one face thereof by releasable detaching means.

7. A practice ball and a ball target for use with said ball as defined in claim 4 wherein said sphere comprises a hollow shell of plastic having radially extending openings therethrough.

8. A practice ball and a ball target for use with said ball as defined in claim 5 wherein said adjustable detachable means comprises elongated pile tabs extending from the peripheral front of said target surface adapted to be applied around said target body and burr material on the back of said target adapted to adjustably receive said pile tabs to allow said target to be adjustably and reversably secured to a supporting frame.

* * * * *